US010252439B2

(12) United States Patent
Bindhammer

(10) Patent No.: US 10,252,439 B2
(45) Date of Patent: Apr. 9, 2019

(54) TABLE SAW AND PUSH STICK FOR THE TABLE SAW

(71) Applicant: Scheppach Fabrikation von Holzbearbeitungsmaschinen GmbH, Ichenhausen (DE)

(72) Inventor: Markus Bindhammer, Friedberg (DE)

(73) Assignee: Scheppach Fabrikation von Holzbearbeitungsmaschinen GmbH, Ichenhausen (DE)

( * ) Notice: Subject to any disclaimer, the term of this patent is extended or adjusted under 35 U.S.C. 154(b) by 0 days.

(21) Appl. No.: 15/656,627

(22) Filed: Jul. 21, 2017

(65) Prior Publication Data

US 2018/0085967 A1 Mar. 29, 2018

(30) Foreign Application Priority Data

Sep. 28, 2016 (EP) ..... 16020359

(51) Int. Cl.
*B27B 25/10* (2006.01)
*B27G 19/02* (2006.01)
*B27G 19/06* (2006.01)

(52) U.S. Cl.
CPC ..... *B27B 25/10* (2013.01); *B27G 19/02* (2013.01); *B27G 19/06* (2013.01);
(Continued)

(58) Field of Classification Search
CPC ..... B27G 19/00; B27G 19/02; B27G 19/06; Y10T 83/6638; Y10T 83/6657;
(Continued)

(56) References Cited

U.S. PATENT DOCUMENTS 4,370,909 A 2/1983 Jennings
7,359,762 B2 * 4/2008 Etter ..... G05B 19/409 700/160

(Continued)

FOREIGN PATENT DOCUMENTS

CN 203460275 U * 3/2014 ..... B27B 25/10
DE 202005010656 U1 12/2005
DE 202010004458 U1 9/2011

OTHER PUBLICATIONS

European Standard EN 1807 (Aug. 1999), 84 pages.
European Standard EN 61029-2-5 (Nov. 2011), 21 pages.
European Standard EN 62841-3-1 (Aug. 2014), 55 pages.

*Primary Examiner* — Laura M Lee
(74) *Attorney, Agent, or Firm* — Ewers & Hasselmann PLLC

(57) ABSTRACT

A push stick for a table saw and a table saw with the push stick are provided. The push stick includes a gripping possibility for a machine operator at its operator-side end. A workpiece engagement notch is formed at the push stick's workpiece-side end. The notch includes a push surface facing in an intended feed direction of the workpiece and a holding-down surface protruding therefrom at the top under a preferably right angle. The push stick includes a detection device which detects whether the push surface and the holding-down surface lie flat against the workpiece. The push stick further includes a signaling device which emits a flat contact signal when the detection device has detected a flat contact of the push surface and the holding-down surface on the workpiece. The signal therefore signals whether the push surface and the holding-down surface lie flat against the workpiece.

21 Claims, 3 Drawing Sheets

(52) U.S. Cl.
CPC ..... *Y10T 83/6638* (2015.04); *Y10T 83/7734* (2015.04); *Y10T 83/856* (2015.04)

(58) Field of Classification Search
CPC ..... Y10T 83/736; Y10T 83/773; Y10T 83/6608–83/6612; B27B 25/10; B27B 5/29
USPC ..... 83/522.15, 522.16, 522.17, 522.18, 83/522.26, 522.28, 435.11–435.14; 33/640, 366.12, 533–535, 366.21, 366.26, 33/474, 194
See application file for complete search history.

(56) References Cited

U.S. PATENT DOCUMENTS

| | | | | |
|---|---|---|---|---|
| 7,989,718 | B1 | 8/2011 | Weber | |
| 8,919,231 | B2 * | 12/2014 | Butler | B27B 5/222 83/397.1 |
| 2011/0226105 | A1 * | 9/2011 | Butler | B27B 5/222 83/62 |

* cited by examiner

TABLE SAW AND PUSH STICK FOR THE TABLE SAW

CROSS REFERENCE TO RELATED APPLICATIONS

This application claims priority to European patent application EP 16 020 359.2, filed Sep. 28, 2016, the entire content of which is incorporated herein by reference.

TECHNICAL FIELD

The invention relates to a table saw and to a push stick for said saw.

BACKGROUND

Table saws of the generic type have a machine table, which is penetrated by a motor-driven saw blade. Workpieces are then placed on the machine table and pushed towards the saw blade, where the saw blade then comes into contact with the workpiece and saws it apart when the forward feed is continued.

Working on such table saws, for example table circular saws, or also on table band saws, is associated with considerable dangers. In particular, the hand of the machine operator guiding the workpiece to be sawn is thereby exposed to the risk of being accidentally passed over the saw blade and thereby being seriously injured.

For the protection of the machine operator, and in particular of his hand guiding the workpiece, various devices are already known. For example, U.S. Pat. No. 4,370,909 shows a hand protection device whose hand grip permits the workpiece to be fed to the saw blade without the hand used for this purpose being able to come into contact with the saw blade. In this case, a deadman switch is provided on the hand grip, which—when released—cuts off the motor of the saw.

A similar device is shown in U.S. Pat. No. 7,989,718 B1, in which a switch for switching on and off the power supply of the circular saw is provided on the hand grip of the hand protection device, and in addition an indicator light which indicates the state of the switch.

Furthermore, in the German utility model DE 20 2005 010 656 U1, a parallel stop for a table circular saw can be found which has a feed blade which is moved by a hand grip in the direction of cutting in order to advance the workpiece past the saw. Contact switches are provided at the ends of the feed path of the feed blade.

According to the standard EN62841-3-1, each table circular saw must be equipped with a so-called push stick. If the width of the workpiece to be sawn is less than 10 cm, the push stick should already be used to prevent accidental contact of the saw blade by the hand. Such a push stick can be seen in German utility model DE 20 2010 004 458 U1, wherein a protective hood is additionally provided there over the saw blade and a sensor system is provided on the table circular saw with which a body part of a user is detected.

According to standards EN61029-2-5 and EN1807, table band saws must also be equipped with a push stick.

Such a push stick of the generic type has at its one end a gripping possibility for the machine operator and, at its other end, a corner groove or a notch or workpiece engagement notch in order to engage the workpiece. For this purpose, the workpiece engagement notch has two surfaces arranged at a preferably right angle to one another, i.e., a sliding surface facing the feed direction of the workpiece, and a holding-down surface pressing on the workpiece from above.

SUMMARY

It is an object of the present invention to make the work on a motor-driven table saw, such as, for example, a table circular saw or a band saw, safer with simple means.

Starting from a generic push stick, the push stick according to an aspect of the invention thus has a gripping possibility for a machine operator at its operator-side end, and furthermore at its workpiece-side end spaced therefrom a workpiece engagement notch which is suitable for acting on the workpiece and which comprises a push surface facing in the direction of the workpiece feed and a holding-down surface projecting therefrom at the top side under an angle. According to an aspect of the invention, the push stick now also has a detection device which detects whether the push surface and the holding-down surface lie flat against the workpiece, as well as a signaling device which emits a respective flat contact signal in response to whether or not the detection device has detected such a flat contact of the push surface and the holding-down surface, which signaling device therefore signals whether or not the push surface and the holding-down surface lie flat against the workpiece. Therein, the angle at which the holding-down surface protrudes from the push surface will generally be a right angle since the workpieces to be sawn are usually boards with side edges adjoining each other at right angles. For special applications, however, a different angle could also be provided.

The table saw according to an aspect of the invention is correspondingly equipped with such a push stick. The table saw according to another aspect of the invention can have a motor-driven saw blade which penetrates a machine table and can be designed, for example, as a table circular saw or as a table band saw.

Since it is currently detected and signaled whether both the push surface and the holding-down surface lie flat against the workpiece, slipping of the push stick during the workpiece feed to the saw blade can be avoided. A forward bending of the machine operator to visually check whether both surfaces lie flat against the workpiece, which represents an additional source of danger, can thus be avoided. Rather, the machine operator, who is at the other end of the push stick, is given the opportunity for the first time to ascertain whether or not flat contact is predominant on the workpiece.

Advantageous further developments are the subject matter of the remaining sub claims.

Thus, the detection device on the push surface and on the holding-down surface can each have at least one recessed push-button switch, which indicates whether the respective surface rests against the workpiece or not. In this case, the push-button switches are more preferably recessed with respect to the push surface or the holding-down surface, and are advantageously recessed in such a way that actuation of the respective push-button switch takes place only when the respective surface lies flat against the workpiece.

The momentary-contact or pushbutton switches can be designed as micro-switches. If the two pushbutton switches are advantageously connected in an AND gate, so that the detection device detects flat contact only when both micro-switches are actuated by the pressure exerted by the workpiece, a simple and reliable design is obtained.

Alternatively, or additionally, the detection device can also have an electro-optical or electro-acoustic scanning device which detects whether the push surface and the holding-down surface lie flat against the workpiece.

The signaling device can, on the other hand, comprise an LED or another light which is illuminated in the case of flat contact, i.e., for example when the AND gate is closed by a pressure exerted on the push surface and the holding-down surface by the workpiece. Alternatively, or in addition, a different kind of signaling device can also be considered, e.g., an acoustic alarm when there is no flat contact or a corresponding vibration feedback.

If the signaling device has a wire-bound or preferably wireless communication interface, such as, for example, a Bluetooth or Wifi interface, via which the flat contact signal can be transmitted, and the machine controller of the table saw has a correspondingly assigned communication interface, the flat contact signal can also be evaluated on the machine side.

Thus, the machine controller can generally comprise an actuator and an actuating device for the actuator, which actuates the actuator in response to whether or not the flat contact signals that the push surface and the holding-down surface lie flat against the workpiece. As an actuator, an ON/OFF switch is mainly considered for driving the saw blade in order to allow the table saw to be switched on only when the work piece is guided by a push block. An emergency stop switch, or even a brake for the saw blade, would also be conceivable as an actuator in order to stop the saw blade as quickly as possible when there is no more flat contact.

In order to evaluate the flat contact signal delivered by the pushbutton switches of the detection device, a debouncing device is advantageously provided for debouncing the flat contact signal, wherein the debouncing device preferably has a low-pass filter, a flip-flop and/or a microcontroller with debouncing software. The debouncing device can be part of the signal transmitter device on the push block or part of the machine controller on the table saw.

A button cell receptacle, into which a button cell is inserted, is also advantageously provided for the power supply of the detection device and the signal transmitter device on the push stick. However, a cable-connected power supply would also be conceivable especially in case of a wire-bound transmission of the flat contact signal.

BRIEF DESCRIPTION OF THE DRAWINGS

The invention will now be described with reference to the drawings wherein.

DESCRIPTION OF EXEMPLARY EMBODIMENTS

Figure 1:
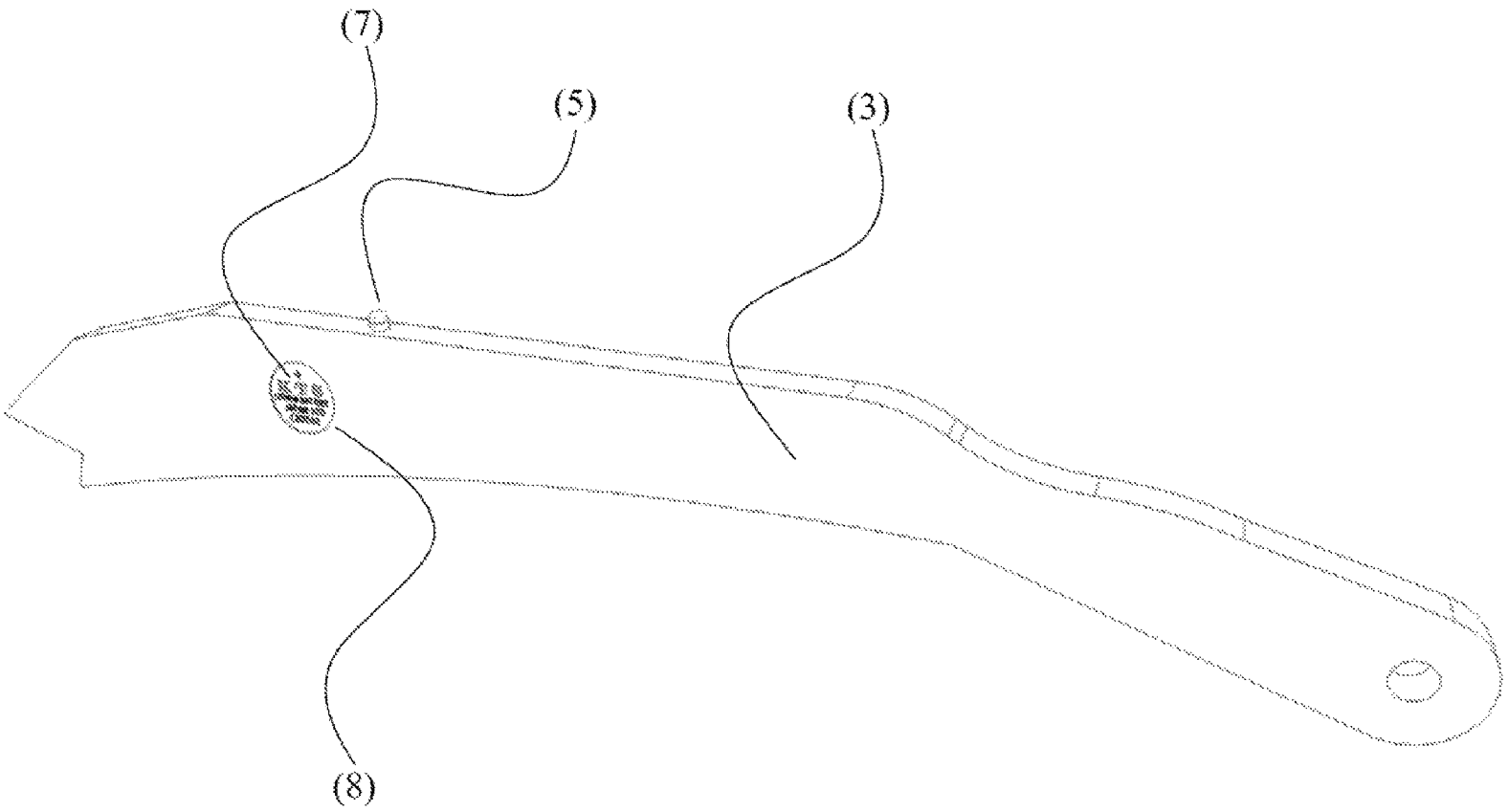
FIG. 1 shows a side view of an exemplary embodiment of a push stick.
Figure 2:
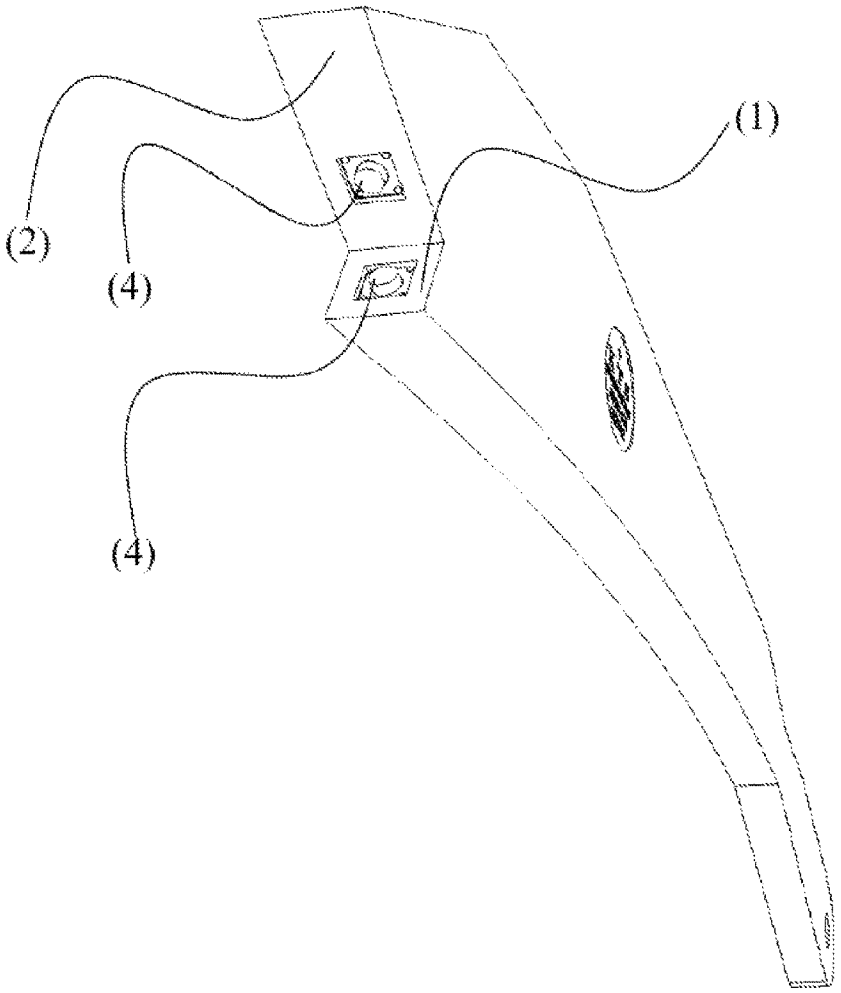
FIG. 2 shows a perspective front view of the push stick shown in FIG. 1.

Reference is made firstly to FIGS. 1 and 2, which show a push stick 3 which can be gripped at its right end in FIG. 1 by a machine operator of a table circular saw or a table saw so that, with its left end in FIG. 1, a workpiece engagement notch can be brought into engagement with a workpiece to be pushed past a saw blade of the table circular saw/table band saw. For this purpose, the workpiece engagement notch has a push surface 1 and a holding-down surface 2 protruding therefrom at a right angle to the workpiece, so that the push stick 3 with its push surface 1 and its holding-down surface 2 is arranged in a planar manner on a workpiece which is constructed for example as a board with side surfaces adjoining at right angles.

Two micro-buttons or micro-switches 4 are disposed on the push surface 1 and on the holding-down surface 2 of the push stick 3. The scanning could also take place by electro-optical or electro-acoustic scanning instead of or in addition to these electromechanical components, as long as the detection device 4 formed thereby detects whether the push surface 1 and the holding-down surface 2 lie flat against the workpiece.

Furthermore, the push stick 3 has an LED 5, which serves as signalling device 5 which, in response to whether or not the detection device 4 formed by the two micro-switches 4 detects the flat contact of the sliding surface 1 and the holding-down surface 2 on the workpiece, emits a flat contact signal which signals whether or not the push surface 1 and the holding-down surface 2 rest flat against the workpiece. In the exemplary embodiment, the LED 5 thus lights up in the case of flat contact. It could, of course, also be the case that the LED 5 is illuminated as a warning light when there is no flat contact on both sides. Furthermore, the signalling device 5 could also comprise a different signal transmitter alternatively or additionally to the LED 5, for example an acoustic signalling device or a vibration alarm. Furthermore, it would be conceivable for the signalling device to have a communication module or a communication interface, for example a Bluetooth or WLAN transmitter/receiver, via which it is connected to a machine controller of the table circular saw. Thus, for example, it would be possible for the table circular saw to be put into operation only when the push surface 1 and the holding-down surface 2 of the push stick 3 abut or lie flat against the workpiece.

Figure 3:
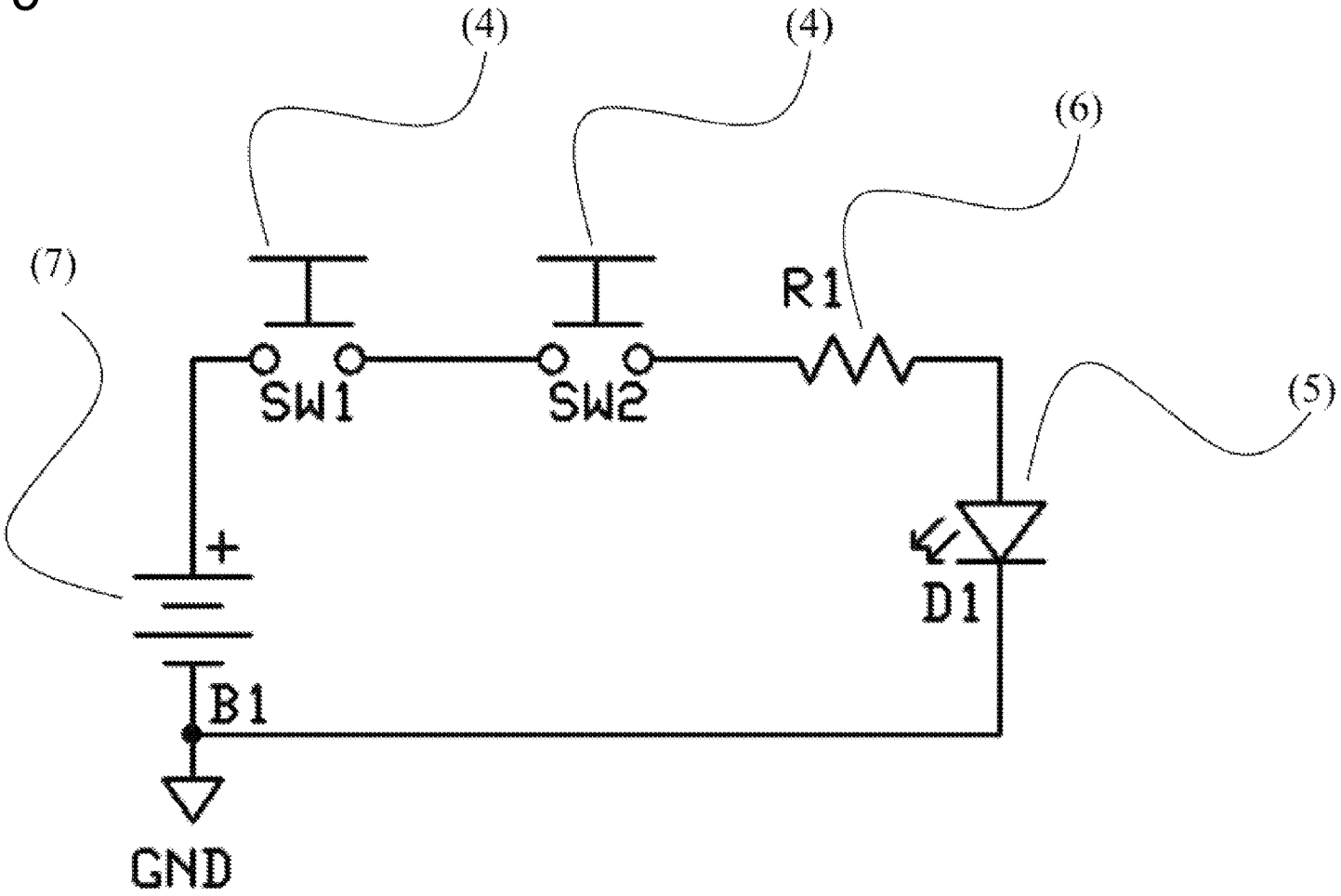
FIG. 3 shows a circuit diagram of the push stick shown in FIGS. 1 and 2.

FIG. 3 shows the circuit diagram of the push stick 3 and thus the electrical connection of the micro-switches 4 with the LED 5 and the button cell 7 provided as a power supply which is inserted into a button cell holder 8 shown in FIG. 1. The two micro-switches 4 are connected as AND gates, i.e., the LED 5 is only illuminated when both micro-switches 4 are actuated, i.e., when both surfaces 1, 2 lie flat against the workpiece. The illuminating LED 5 thus indicates to the machine operator using the push stick 3 that the workpiece can be fed to the saw blade of the table saw with the greatest possible safety.

In order to be able to utilize the flat contact signal output by the two micro-switches 4 also for sensitive signal processing devices, e.g., on the machine controller of the circular saw, it is advantageous to debounce the micro-switches 4. This can be done, for example, by a low-pass filter, a flip-flop or by a microcontroller with corresponding software.

Variations and modifications of the embodiments shown are possible without departing from the scope of the invention.

It is understood that the foregoing description is that of the exemplary embodiments of the invention and that various changes and modifications may be made thereto without departing from the spirit and scope of the invention as defined in the appended claims.

What is claimed is:

1. A push stick for a table saw, comprising:

a grip end for a machine operator at an operator-side end of the push stick;

a workpiece engagement notch suitable for acting on a workpiece being formed at a workpiece-side end of the push stick, and being spaced apart from the grip end, wherein the workpiece engagement notch comprises a push surface facing in an intended feed direction of the workpiece and a holding-down surface protruding from a top of the push surface;

a detection device which detects whether the push surface and the holding-down surface lie flat against the workpiece; and a signaling device which emits a respective flat contact signal in response to when the detection device has detected a flat contact of the push surface and the holding-down surface on the workpiece, wherein the flat contact signal signals that the push surface and the holding-down surface lie flat against the workpiece.

2. The push stick according to claim 1, wherein the detection device on the push surface and on the holding-down surface each comprise at least one pushbutton switch which is recessed in such a way that actuation of the respective pushbutton switch takes place only when the respective surface lies flat against the workpiece.

3. The push stick (3) according to claim 2, wherein the detection device comprises a respective micro-switch on the push surface and on the holding-down surface, and wherein the two micro-switches are switched in an AND gate to permit the detection device to detect flat contact only when both micro-switches are actuated.

4. The push stick according to claim 1, wherein the detection device has an electro-optical or electro-acoustic scanning device which detects whether the push surface and the holding-down surface lie flat against the workpiece.

5. The push stick according to claim 1, wherein the signaling device comprises an LED which is illuminated under flat contact.

6. The push stick according to claim 2, wherein the signaling device comprises an LED which is illuminated under flat contact.

7. The push stick according to claim 1, wherein the signaling device comprises a wire-bound or a wireless communication interface, via which the flat contact signal can be transmitted.

8. The push stick according to claim 2, wherein the signaling device comprises a wire-bound or a wireless communication interface, via which the flat contact signal can be transmitted.

9. The push stick according to claim 4, wherein the signaling device comprises a wire-bound or a wireless communication interface, via which the flat contact signal can be transmitted.

10. The push stick according to claim 1, wherein the signaling device comprises a debouncing device for debouncing the flat contact signal, and wherein the debouncing device comprises a low-pass filter, a flip-flop and/or a microcontroller with debouncing software.

11. The push stick according to claim 2, wherein the signaling device comprises a debouncing device for debouncing the flat contact signal, and wherein the debouncing device comprises a low-pass filter, a flip-flop and/or a microcontroller with debouncing software.

12. The push stick according to claim 3, wherein the signaling device comprises a debouncing device for debouncing the flat contact signal, and wherein the debouncing device comprises a low-pass filter, a flip-flop and/or a microcontroller with debouncing software.

13. The push stick according to claim 6, wherein the signaling device comprises a debouncing device for debouncing the flat contact signal, and wherein the debouncing device comprises a low-pass filter, a flip-flop and/or a microcontroller with debouncing software.

14. A table saw comprising:

a push stick including a grip end for a machine operator at an operator-side end, and a workpiece engagement notch suitable for acting on a workpiece, the workpiece engagement notch being formed at a workpiece-side end of the push stick and being spaced apart from the grip end, wherein the workpiece engagement notch comprises a push surface facing in an intended feed direction of the workpiece and a holding-down surface protruding from a top of the push surface under a right angle, and wherein the push stick comprises a detection device and a signaling device, wherein the detection device detects whether the push surface and the holding-down surface lie flat against the workpiece, wherein the signaling device emits a respective flat contact signal in response to when the detection device has detected a flat contact of the push surface and the holding-down surface on the workpiece, and wherein the flat contact signal signals that the push surface and the holding-down surface lie flat against the workpiece.

15. The table saw according to claim 14, wherein the push stick comprises a wire-bound or a wireless communication interface, via which the flat contact signal can be transmitted, and a machine controller of the table saw comprises a respective wire-bound or a respective wireless communication interface, via which the flat contact signal can be received, wherein the machine controller comprises an actuator and an actuating device for the actuator, wherein the actuating device actuates the actuator in response to when the flat contact signal signals that the sliding surface and the holding-down surface lie flat against the workpiece.

16. The table saw according to claim 15, wherein the actuator is an ON/OFF switch for driving the saw blade.

17. The table saw according to claim 14, wherein the detection device on the push surface and on the holding-down surface each comprise at least one pushbutton switch which is recessed in such a way that actuation of the respective pushbutton switch takes place only when the respective surface lies flat against the workpiece.

18. The table saw according to claim 17, wherein the detection device comprises a respective micro-switch on the push surface and on the holding-down surface, wherein the two micro-switches are switched in an AND gate to permit the detection device to detect flat contact only when both micro-switches are actuated.

19. The table saw according to claim 14, wherein the detection device has an electro-optical or electro-acoustic scanning device which detects whether the push surface and the holding-down surface lie flat against the workpiece.

20. The table saw according to claim 14, wherein the signaling device comprises an LED, which is illuminated under flat contact.

21. The push stick according to claim 1, wherein the holding-down surface protrudes with a right angle from the top of the push surface.

* * * * *